US007241123B2

(12) United States Patent
Kirchhoff et al.

(10) Patent No.: US 7,241,123 B2
(45) Date of Patent: Jul. 10, 2007

(54) APPARATUS FOR PRODUCING AND WINDING SYNTHETIC MULTIFILAMENT YARNS

(75) Inventors: Bernd Kirchhoff, Neumünster (DE); Bernd Aretz, Rodgau (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 163 days.

(21) Appl. No.: 11/208,578

(22) Filed: Aug. 22, 2005

(65) Prior Publication Data

US 2006/0003037 A1 Jan. 5, 2006

Related U.S. Application Data

(63) Continuation of application No. PCT/EP2004/001571, filed on Feb. 19, 2004.

(30) Foreign Application Priority Data

Feb. 21, 2003 (DE) ..... 103 07 500

(51) Int. Cl.
*D01D 7/00* (2006.01)

(52) U.S. Cl. ..... 425/66; 425/72.2; 425/377; 425/382.2; 425/404; 425/DIG. 17

(58) Field of Classification Search ..... 425/66, 425/72.2, 377, 382.2, 404, DIG. 17
See application file for complete search history.

(56) References Cited

U.S. PATENT DOCUMENTS 2,249,988 A 7/1941 Thomas
3,544,017 A * 12/1970 Neuhaus et al. ..... 425/66
3,666,154 A * 5/1972 Ishida et al. ..... 28/240
3,720,382 A * 3/1973 Lehner ..... 425/72.2
5,343,601 A * 9/1994 Schippers ..... 242/472.8
5,794,868 A 8/1998 Busenhart et al.
5,928,579 A 7/1999 Spahlinger et al.
6,210,143 B1 * 4/2001 Takagi et al. ..... 425/382.2
6,439,498 B1 8/2002 Hufschmidt et al.
6,494,700 B1 * 12/2002 Stammen ..... 425/382.2
2005/0129799 A1 * 6/2005 Schroter ..... 425/382.3

FOREIGN PATENT DOCUMENTS

DE 862207 C 1/1953
EP 0 845 550 A1 6/1998
WO WO 96/09425 A1 3/1996

* cited by examiner

*Primary Examiner*—Robert Davis
*Assistant Examiner*—Joseph Leyson
(74) *Attorney, Agent, or Firm*—Alston & Bird LLP

(57) ABSTRACT

An apparatus for producing and winding synthetic multifilament yarns, which has a spin unit 1 for melt spinning the yarns, at least one treatment unit 7 for treating the yarns, and a takeup unit 16 with a plurality of winding positions for winding the yarns. The winding positions 17.1-17.3 are distributed along a horizontal axis of the takeup unit 16, with a driven guide roll 12 and a yarn guide 15.1-15.3 for each winding position being arranged upstream thereof for advancing the yarn. To prevent different yarn deflections despite a different spacing between yarns while treating and while winding the yarns, the invention provides for orienting the guide roll 12 with its roll axis in the vertical direction to guide the yarns, and for arranging it laterally adjacent the yarn guides 15.1-15.3 such that the yarns can be advanced substantially in parallel relationship between the guide roll 12 and the yarn guides 15.1-15.3.

13 Claims, 4 Drawing Sheets

APPARATUS FOR PRODUCING AND WINDING SYNTHETIC MULTIFILAMENT YARNS

CROSS REFERENCE TO RELATED APPLICATION

The present application is a continuation of international application PCT/EP2004/001571, filed 19 Feb. 2004, and which designates the U.S. The disclosure of the referenced application is incorporated herein by reference.

BACKGROUND OF THE INVENTION

The present invention relates to an apparatus for producing and winding synthetic multifilament yarns.

Apparatus of this type for producing and winding a plurality of synthetic multifilament yarns, which comprise a spin unit with a plurality of spinnerets, a treatment unit, and a takeup unit with a plurality of winding positions, are known in general. In these apparatus, a melt producer distributes in the spin unit a polymer melt to a plurality of spinnerets. In each of the spinnerets, the polymer melt is extruded under pressure to strandlike filament bundles, which are combined to a yarn after cooling. Thereafter, the yarns jointly advance through a treatment unit to receive defined physical properties. After the treatment, the yarns are individually wound to packages.

Depending on the construction of the individual devices, the yarns advance inside the apparatus in differently spaced relationships. For example, EP 0 845 550 and corresponding U.S. Pat. No. 5,928,579 disclose that the spacing between yarns differs respectively in the spinning, treating, and winding steps. Thus, after the treatment step, it is necessary to spread the yarns for winding to a larger spacing between yarns, so that the advancing conditions of the yarns from a guide roll upstream of the takeup unit differ from yarn to yarn. In particular in cases, where the yarns are imparted a crimp in the treatment unit, a spreading and therewith connected friction values by yarn guides and the different downstream advancing conditions may directly have a negative effect on the quality data of the crimped yarns.

To distribute the yarns after their treatment as much as possible under identical deflection conditions to the individual winding position of the takeup unit, there are only devices known in the art, wherein the guide roll upstream of the takeup unit is dimensioned in its length such that the yarns are able to advance after their treatment substantially parallel to the takeup device. Devices of this type, as are disclosed, for example, in WO 96/09425 and corresponding U.S. Pat. No. 5,794,868, but they have the disadvantage that the units for treating and guiding the yarns must be designed for a spacing between yarns that is predefined by the winding positions. With that, long-projecting as well as very wide treatment units are needed, which result in particular in an inferior operability.

It is therefore an object of the invention to provide an apparatus of the described type for producing and winding synthetic multifilament yarns, which permits advancing the yarns for the most part under identical conditions from a small spacing between yarns necessitated by a treatment unit to a larger spacing between yarns necessitated by a takeup unit.

SUMMARY OF THE INVENTION

The above and other objects and advantages of the invention are achieved by the provision of an apparatus of the described type and which includes a guide roll positioned between the treatment unit and the take up unit. The guide roll acts to advance the yarns toward yarn guides which are associated with the takeup positions, and the guide roll is vertically oriented and arranged laterally of yarn guides such that it permits advancing the yarns in a substantially parallel relationship between the guide roll and the yarn guides. Also, the guide roll causes the yarns to advance parallel to the longitudinal axis to the yarn guides of the takeup unit.

At the yarn guides, each of the yarns is deflected by about 90° to advance into the winding positions. Thus, each of the yarns is guided between the guide roll and the winding position under identical conditions. The spacing between yarns on the guide roll, which is advantageously determined by the preceding treatment unit, can thus be selected independently of the spacing between winding positions. Even great differences in the yarn spacing between the treatment unit and the takeup unit can be advantageously bridged on each yarn by identical looping conditions.

To distribute the yarns from the guide roll to the winding positions with the least possible friction, an advantageous further development of the invention provides for the yarn guides to be in the form of freely rotatable deflection rolls. To realize a parallel advance of the yarn between the guide roll and the deflection rolls, it is possible to arrange the deflection rolls respectively at the same height as the yarns advancing from the guide roll. However, it is also possible to arrange the deflection rolls at a common height.

To adjust defined yarn tension conditions on the yarns, the further development of the invention is especially suited, wherein the deflection rolls are adapted to be driven individually or in groups. With that, it is possible to control a decrease of the yarn tension, which is favorable for the winding of the yarns.

Preferably, a companion roll having a same orientation is associated to the guide roll, so that the yarns can be guided over the guide roll by looping it several times. With that, it is possible to apply particularly high withdrawal forces for withdrawing the yarns. Thus, for example, the yarns could be directly withdrawn from the spin unit and advanced to the takeup unit. On the other hand, the higher yarn tensions lead to a safe and smooth advance of the group of yarns on the circumference of the guide roll.

The advantageous further development of the invention, wherein the yarn guides directly precede the winding positions in such a manner that in the path of the advancing yarns, each yarn guide is followed by a yarn traversing device of the takeup unit, distinguishes itself by a compact and short construction. In this case, the drive and control means of the guide roll can be advantageously combined with the drive and control means of the takeup unit to one unit.

To be able to maintain a vertical orientation of the apparatus for producing and winding synthetic multifilament yarns, a particularly preferred further development of the invention provides for arranging in the yarn path, upstream of the guide roll, a deflection device for varying the path of the advancing yarns, preferably by an angle of about 90°. With that, it is possible to perform a distribution, independently of the upstream spin units and treatment units, while considering identical looping conditions.

The deflection device can be formed by yarn guide elements, or advantageously by one of more guide rolls that are obliquely arranged in the direction of the yarns advancing upstream and downstream thereof. With that, it becomes possible to vary the direction of the group of yarns in particular with little friction.

The treatment unit upstream of the guide roll can comprise any of the variety of desired devices that perform a treatment on the yarn. For example, the treatment unit could be an entanglement device, which subjects each of the yarns to an entanglement for improving cohesion in the yarn.

In many cases, however, it is necessary that the produced synthetic multifilament yarns have a certain orientation. To this end, the treatment unit could comprise a draw zone, in which the freshly spun yarns are drawn before being wound.

As an alternative or for further treatment, the treatment unit could be provided in the form of a crimping device and a feed system downstream thereof. Such treatment units are especially suited for producing crimped synthetic yarns.

To increase integration of the individual units within the apparatus, the guide roll can also be formed directly as last godet of the draw zone or as last godet of the feed system.

In this connection, there exists the possibility of orienting, for example the godets or godet unit of the draw zone, or the godets or godet units of the feed system with their longitudinal axes substantially in the vertical direction.

BRIEF DESCRIPTION OF THE DRAWINGS

In the following, further advantages of the invention are described in greater detail by reference to several embodiments as illustrated in the attached Figures, in which.

DETAILED DESCRIPTION OF THE PREFERRED EMBODIMENTS

Figure 1:
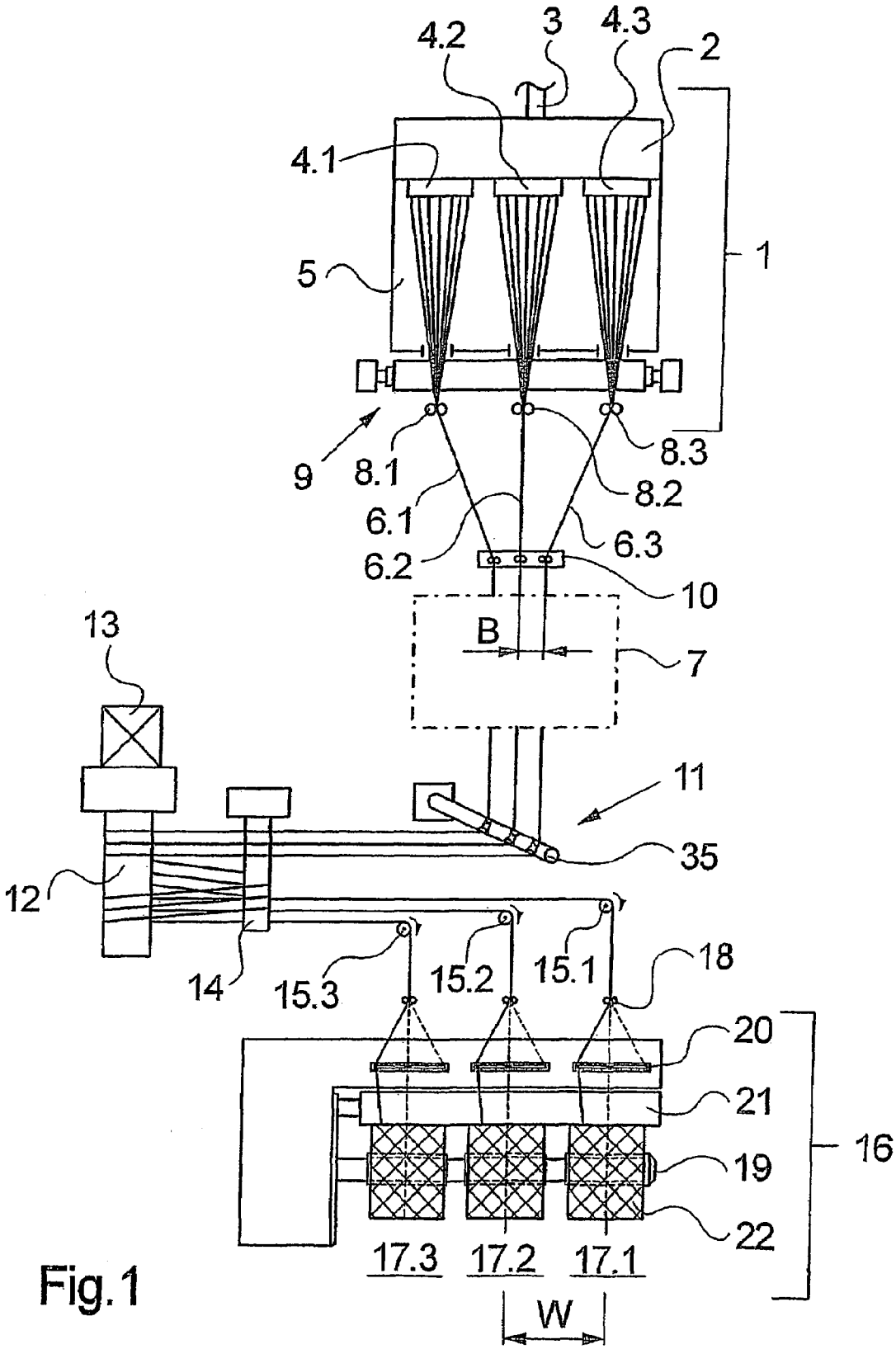
FIG. 1 is a schematic side view of a first embodiment of the apparatus according to the invention.
Figure 2:
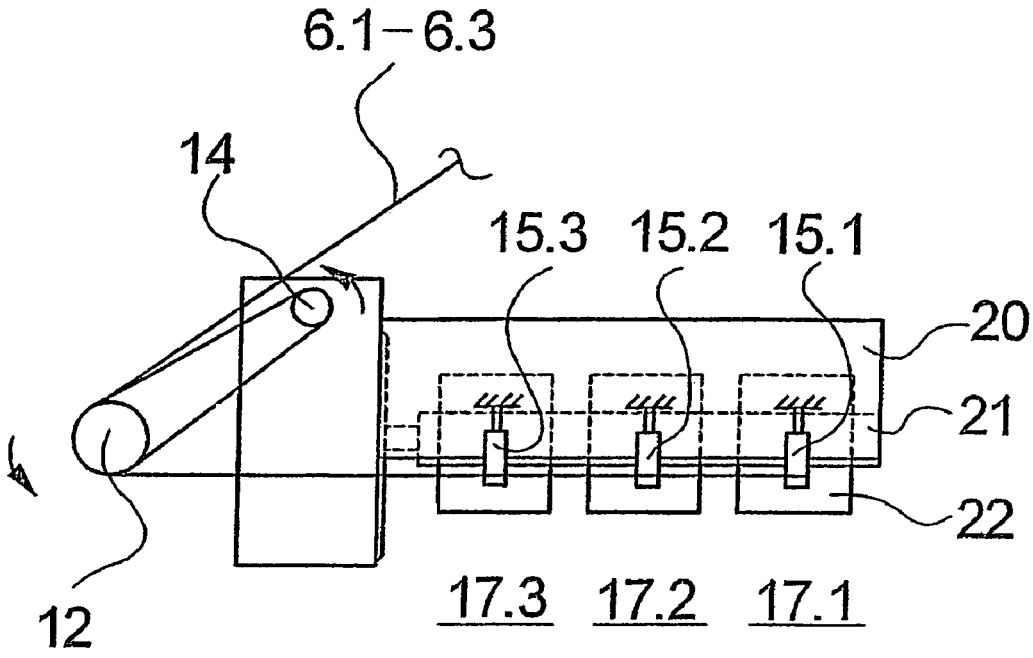
FIG. 2 is a schematic plan view of the takeup unit of the embodiment of FIG. 1.

FIGS. 1 and 2 illustrate several views of a first embodiment of an apparatus according to the invention. FIG. 1 is a side view of the embodiment. FIG. 2 is a plan view of the takeup unit, with an upstream guide roll of the apparatus of FIG. 1. Unless express reference is made to one of the Figures, the following description will apply to both Figures.

The apparatus of the invention comprises a spin unit 1, a treatment unit 7, and a takeup unit 16, with a guide roll 12 being arranged in the transition between the treatment unit 7 and the takeup unit 16. The spin unit 1 includes a heated spin beam 2 that connects via a melt supply line 3 to a source of melt (not shown), for example, an extruder. It is possible to associate a plurality of spin units to a common source of melt, with the spin units extending parallel in side-by-side relationship.

On its underside the spin beam 2 includes a plurality of spinnerets 4.1-4.3. The arrangement of the spinnerets as well as the number of spinnerets is exemplary. For example, it is also possible to arrange on the underside of the spin beam a plurality of spinnerets in a plurality of rows or in circular configurations.

Each of the spinnerets 4.1-4.3 includes a plurality of spin holes to extrude from a polymer melt supplied via the melt supply line respectively one filament bundle of a multifilament yarn 6.1-6.3. Downstream of the spin beam 2, a cooling shaft 5 is provided, through which the filament bundles advance for purposes of cooling. To this end, it is preferred to generate a cooling air stream by a quench-flow system (not shown). In the outlet region of the cooling shaft 5, a yarn lubrication device 9 and a plurality of yarn guides 8.1-8.3 are arranged to combine the filament bundles to respective yarns 6.1-6.3. The yarn lubrication device 9 is shown by way of example as a roll-type lubrication device, wherein the filament strands advance on the circumference of a roll. The surface of the roll is wetted with a yarn lubricant. It is also possible to use other systems, such as a pin lubrication device or a spray lubrication device.

Arranged downstream of the spin unit 1 is the treatment unit 7, which preferably includes at least one withdrawal godet for jointly withdrawing the yarns from the spin unit 1. The yarns 6.1-6.3 advance through the treatment unit 7 for the most part parallel, with the spacing between yarns being defined by a yarn guide strip 10 associated to the treatment unit 7. With that, the yarns 6.1-6.3 are brought together to a narrower spaced relationship between the yarn guides 8.1-8.3 and the yarn guide strip 10.

In the present embodiment, the treatment unit 7 is not described in greater detail, and may be formed by any desired treatment devices. The type of treatment unit 7 largely depends on the yarn type being produced. For example, it is possible to produce crimped and uncrimped yarns as well as partially drawn and fully drawn yarns. In particular, the apparatus of the invention is excellently suited for the BCF process, as well as the FDY process, and similar processes. In the following, several embodiments of the treatment unit 7 are described in greater detail.

After the treatment, it is necessary to advance the yarns 6.1-6.3 to individual winding positions 17.1-17.3 of the takeup unit 16. In the takeup unit, the spacing between two adjacent winding positions 17.1 and 17.2 is substantially greater than the spacing between the yarns 6.1 and 6.2 in the treatment unit 7. To advance each of the yarns 6.1-6.3 under identical conditions and identical yarn advancing circumstances from the treatment unit 7 to the takeup unit 16, a deflection device 11 is arranged in the yarn path downstream of the treatment unit 7. The deflection device 11 is formed by a deflection roll 35, which deflects the group of the yarns 6.1-6.3 in their advancing direction by 90°. Preferably, the deflection roll 35 includes a guide groove for each yarn. Arranged laterally adjacent the deflection device 11 is a driven guide roll 12. With its longitudinal axis, the guide roll 12 has a vertical orientation. The guide roll 12 is driven by a drive 13. Associated to the guide roll 12 is a freely rotatable companion roll 14, so that after its deflection, the group of the yarns 6.1-6.3 is able to advance on the circumference of the guide roll 12 in several loopings.

Downstream of the deflection device 11 and laterally adjacent to the guide roll 12, three deflection rolls 15.1-15.3 are arranged, which are associated to the winding positions 17.1-17.3. The deflection rolls 15.1-15.3 are each oriented above the longitudinal center of each of the winding positions 17.1-17.3. The deflection rolls 15.1-15.3 are made freely rotatable.

To advance the group of yarns with the yarns 6.1-6.3 in parallel between the guide roll 12 and the deflection rolls 15.1-15.3, the deflection rolls 15.1-15.3 are each arranged at the same height as the respective yarns 6.1-6.3 advancing from the guide roll 12. Since in the embodiment of FIG. 1, the yarns 6.1-6.3 are parallel and horizontal, and slightly spaced apart in the vertical direction as they approach the deflections rolls 15.1-15.3, the deflection rolls are at slightly different elevations.

In the path of the advancing yarns, a yarn guide 18 and a yarn traversing device 20 for each of winding positions 17.1-17.3 are arranged downstream of and below the deflection rolls 15.1-15.3. Downstream of the yarn traversing device 20, a contact roll 21 is provided, which lies against the surfaces of packages 22 that are being wound on a winding spindle 19. Preferably, the winding spindle 19 is driven in such a manner that the yarns 6.1-6.3 are wound preferably at a constant takeup speed to the packages 22.

In the embodiment shown in FIG. 1, the group of yarns 6.1-6.3 advances after spinning to the treatment unit 7 with a small spacing B between yarns. The spacing B between yarns, which is also called treatment spacing, is dependent on the number of yarns, and on the kind and way of treatment, that is to be performed on the yarns. For example, it is possible to treat 2, 4, 6, or 8 yarns at the same time. The treatment spacing B, however, is normally substantially smaller than the spacing W between two adjacent yarns in the takeup unit, which is referred to as the takeup spacing. The takeup spacing W thus indicates a dimension for the gauge of the winding positions 17.1-17.3 in the takeup device 16.

To cause the group of yarns to change from its advance with the treatment spacing B to its advance to the winding positions 17.1-17.3 with the takeup spacing W as much as possible without varying the guidance of the individual yarns, the group of yarns advances onto the vertically oriented guide roll 12 with companion roll 14. In so doing, the group of yarns is deflected by the deflection device 11, with the yarns 6.1-6.3 advancing substantially with the treatment spacing B. Thus, the group of yarns loops the guide roll 12 several times, with the spacing B between yarns remaining substantially constant. After leaving the guide roll 12, the yarns 6.1-6.3 advance in parallel, and are distributed one after the other to the individual deflection rolls 15.1-15.3 and guided into the associated winding positions 17.1-17.3. In the winding positions 17.1-17.3, each of the yarns 6.1-6.3 is wound to a package 22.

The embodiment of the apparatus according to the invention as shown in FIG. 1 is basically suited for any kind of treatment of the yarns. In this connection, it is also possible and advantageous to integrate the deflection device 11 and the guide roll 12 into the treatment process. Since it is not possible to show all treatment variants in the production of synthetic multifilament yarns, some of the most important embodiments of a treatment unit are described in the following with reference to FIGS. 3 and 4.

Figure 3:
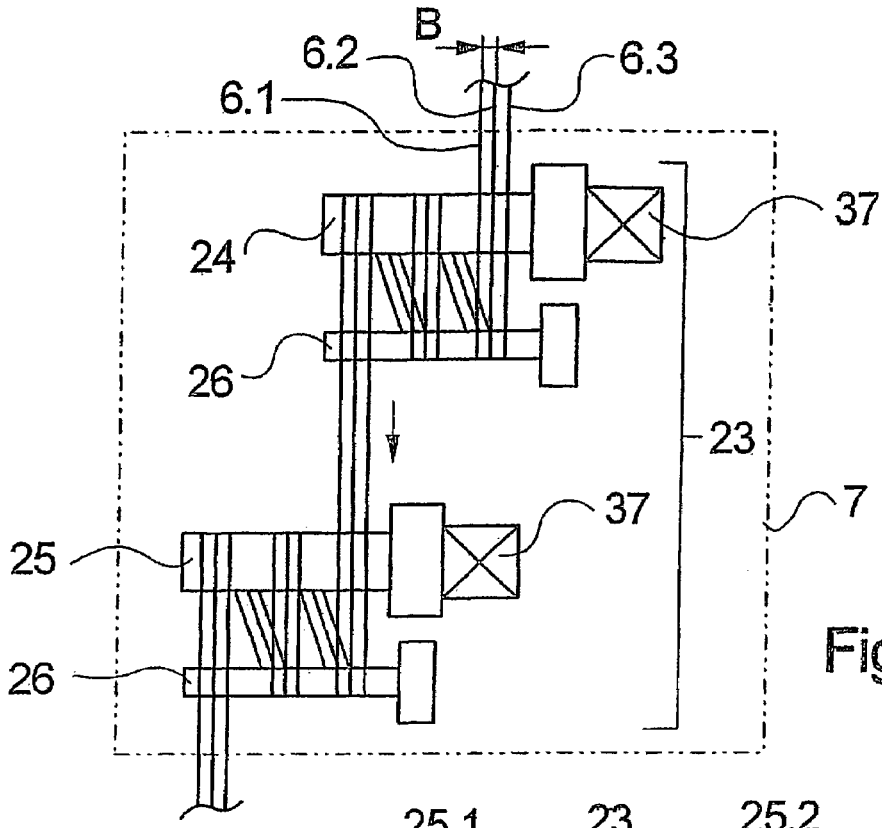
FIG. 3 is a schematic view of a first embodiment of a treatment unit.

The embodiment of FIG. 3 illustrates a draw zone 23, which is formed by a withdrawal godet 24 and a draw godet 25. Associated to the withdrawal godet and the draw godet is respectively one guide roll 26, so that the group of yarns advances with several loopings over the withdrawal godet 24 and the draw godet 25. To draw the group of yarns, the withdrawal godet 24 and the draw godet 25 are driven at different speeds. To this end, the withdrawal godet 24 and the draw godet 25 are each driven by a godet drive 37. During the treatment, the yarns advance at the treatment spacing B.

Figure 4:
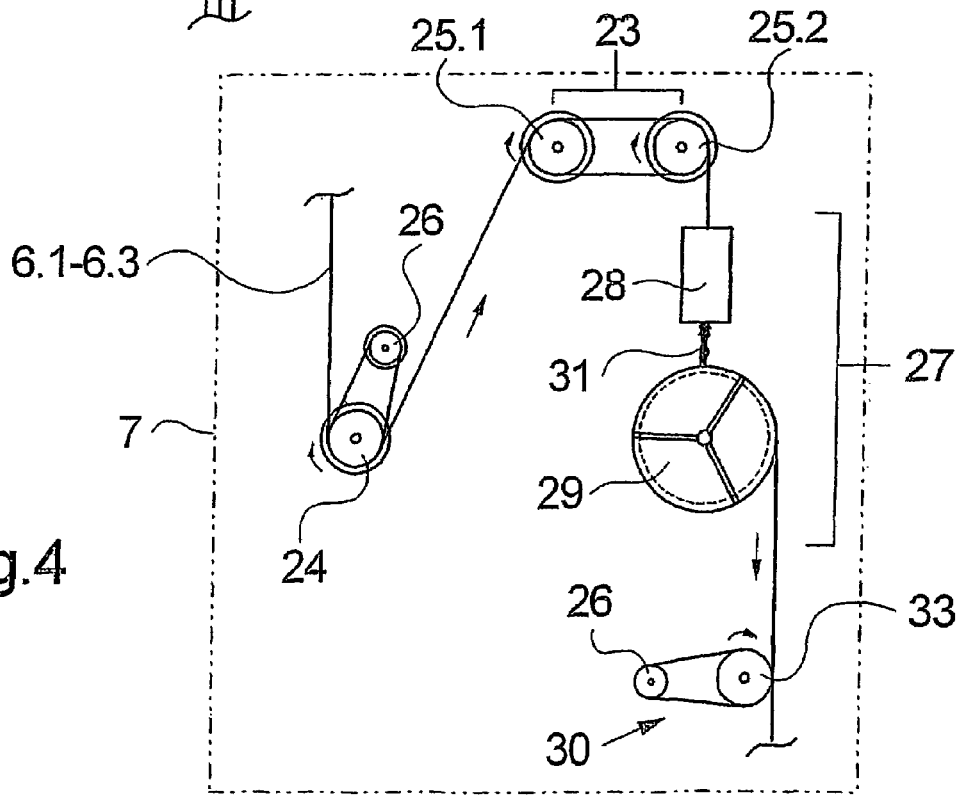
FIG. 4 is a schematic view of a further embodiment of a treatment unit.

FIG. 4 illustrates a further alternative of a treatment unit 7, as could be used, for example, in the embodiment of FIG. 1. The embodiment of FIG. 4 comprises a withdrawal godet 24, a draw zone 23, a crimping device 27, and a feed system 30. The draw zone 23 is formed by two driven draw godets 25.1 and 25.2. Arranged downstream of the draw zone 23 is the crimping device 27, which comprises a texturing nozzle 28 and a cooling drum 29. In this device, each yarn of the group of yarns is formed into a yarn plug 31, which is deposited and cooled on the circumference of the cooling drum 29. After cooling, each of the thus formed yarn plugs 31 is withdrawn by the feed system 30 to a crimped yarn. The feed system 30 comprises a driven godet 33 and an associated guide roll 26. The treatment unit shown in FIG. 4 is thus suitable for producing crimped yarns. Since such crimped yarns are used after spinning and winding directly in further processing to produce a flat structure, for example, a carpet, it is necessary that the yarns be wound to identical packages on the one hand, and that the yarns have identical characteristic values on the other hand. Therefore, the apparatus of the invention is highly preferred for such treatment devices.

Figure 5:
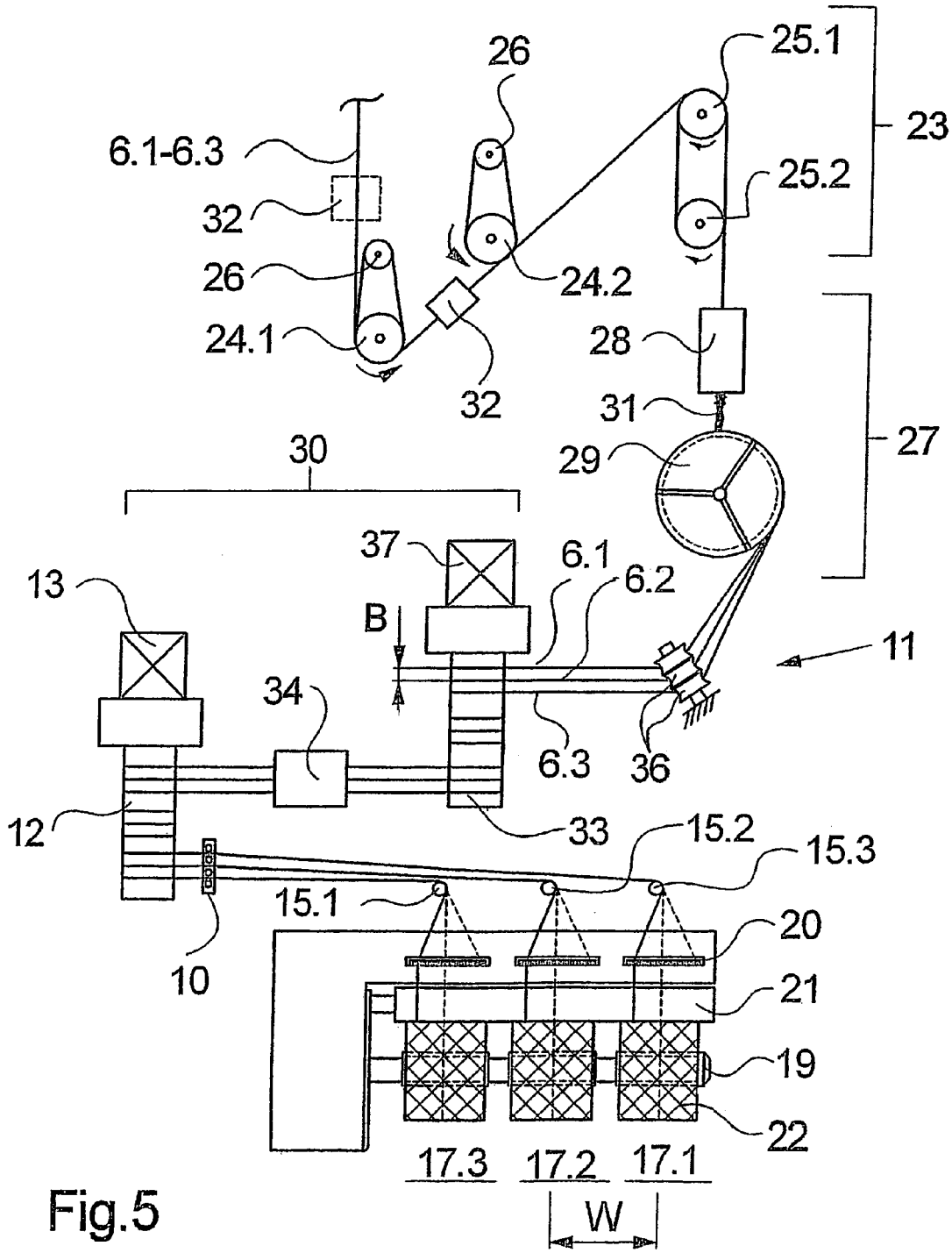
FIG. 5 is a schematic side view of a further embodiment of the apparatus according to the invention.

FIG. 5 illustrates an embodiment of the apparatus according to the invention, as could be constructed, for example, from integrating the embodiment of the treatment unit of FIG. 4 into the apparatus of FIG. 1. In the embodiment of FIG. 5, the spin unit is made identical with the embodiment of FIG. 1, so that was possible to do without illustrating it again. However, unlike the embodiment of FIG. 1, the orientation of the spin unit is 90° out phase, so that the spinning plane extends transversely to the longitudinal direction of the takeup unit 16.

The units provided for treating and advancing the group of yarns are described one after the other with reference to the path of the advancing yarns. To begin with, the group of yarns is withdrawn from the spin unit by a first withdrawal godet 24.1. Arranged downstream of the withdrawal godet 24.1 is a first entanglement device 32 and a second withdrawal godet 24.2. Downstream of the second withdrawal godet 24.2 is a draw zone 23, which is formed by draw godets 25.1 and 25.2. The draw zone 23 is followed by a crimping device 27, which comprises a texturing nozzle 28 and a cooling drum 29. Associated to the cooling drum 29, is a deflecting device 11 that comprises a plurality of freely rotatable guide rolls 36. Each of the guide rolls 36 is associated to one of the yarns 6.1-6.3. The deflection device 11 is followed by a feed system 30, which is formed by a withdrawal godet 33 and the guide roll 12. The withdrawal godet 33 and the guide roll 12 are vertically oriented, with an entanglement device 34 extending in the yarn path between the withdrawal godet 33 and the guide roll 12. Associated to the withdrawal godet 33 is a drive 37, and to the guide roll 12 a drive 13. Associated to the withdrawal godet 33 is a companion roll not shown, so that the group of yarns is able to advance with several loopings on the circumference of the withdrawal godet 33. Likewise associated to the guide roll 12 is a companion roll, which is likewise not shown.

Laterally adjacent to the guide roll 12, deflection rolls 15.1-15.3 extend in side-by-side relationship at the same height. Associated to the deflection rolls 15.1-15.3 are the winding positions 17.1-17.3 of the takeup unit 16. In the path of the advancing yarns, the deflection rolls 15.1-15.3 are directly followed by the yarn traversing device 20, so that that the deflection rolls 15.1-15.3 represent the apex of a yarn traversing triangle.

In the embodiment of the apparatus according to the invention as shown in FIG. 5, the yarns 6.1-6.3 are first withdrawn after spinning and cooling, by the withdrawal godet 24.1, and subsequently entangled in the first entanglement device 32. The first entanglement device 32 can also be advantageously arranged upstream of the withdrawal godet 24.1. After entangling the individual yarns, the withdrawal godet 24.2 advances them to the draw zone for drawing. To this end, the draw godets 25.1 and 25.2 are driven at different circumferential speeds. After drawing, the yarns are each separately textured and compacted to a yarn plug 31. After cooling the yarn plugs 31, the withdrawal roll 33 withdraws the yarns 6.1-6.3 from the circumference of the cooling drum 29. In so doing, the deflection device 11 deflects the group of yarns. The path of the yarns is rotated by about 90°, so that the group of yarns advances parallel with a substantially constant treatment spacing B between yarns on the circumference of the withdrawal godet 33 and the guide roll 12. After texturing, the crimped yarns 6.1-6.3 are one more time entangled by the entanglement device 34 before being wound.

The distribution of the yarns 6.1-6.3 to the individual winding positions 17.1-17.3 occurs by means of the deflection rolls 15.1-15.3. To this end, the yarns are withdrawn from the guide roll 12 parallel to the longitudinal axis of the takeup unit 16, and deflected on the respective deflection rolls 15.1-15.3 by about 90°. In order to not disturb the parallel path of the yarns on the circumference of the guide roll 12 until the yarns 6.1-6.3 leave the roll, a yarn guide strip 10 is arranged downstream of the guide roll 12, which ensures the separation of the yarns 6.1-6.3. Thereafter, the yarns 6.1-6.3 advance to the deflection rolls 15.1-15.3 that extend in a common plane, and since the deflection rolls 15.1-15.3 are at the same elevation above the winding spindle 19, the upper yarns are slightly downwardly inclined but still considered to be in substantially parallel relationship as that phrase is used herein.

The construction and the arrangement of the individual units of the illustrated embodiments are exemplary. Basically, it is possible to supplement the treatment of the yarns and the advance of the yarns with additional devices not shown, such as additional godets, heating devices, or entanglement devices, or guide elements. Essential is that a deflection roll and a vertically oriented guide roll are associated to the takeup unit for distributing the yarns to the individual winding positions. In this connection, it is also possible to integrate the guide roll as a last godet of a yarn feed system. In addition, it would be possible to realize, for example, an additional treatment of the yarns in that the deflection rolls upstream of the winding position are driven individually or in groups, which permits adjusting the tension in the yarns for winding in an advantageous manner. The apparatus of the invention permits realizing for the most part identical conditions for advancing the yarns between their treatment and winding.

The positioning of the guide roll as shown in the embodiments is likewise exemplary for a vertical orientation. Basically, positionings are possible, wherein the roll axis and a horizontal form an angle deviating somewhat from 90°.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. An apparatus for producing and winding synthetic multifilament yarns, comprising a spin unit for melt spinning the yarns, at least one treatment unit for treating the melt spun yarns, at least one takeup unit for winding the yarns into respective packages at a plurality of winding positions that are distributed along a horizontal longitudinal axis, with the takeup unit including a yarn guide positioned upstream of each yarn package for guiding each yarn to the associated package, a driven guide roll for advancing the yarns from the treatment unit to respective ones of the yarn guides, with said driven guide roll defining an axis of rotation which is vertically oriented and arranged laterally adjacent the yarn guides such that the yarns are guided in a substantially parallel relationship with respect to each other between the guide roll and the yarn guides.

2. The apparatus of claim 1, wherein the yarn guides comprise freely rotatable deflection rolls, with the deflection rolls being respectively arranged at the same height above the longitudinal axis as the yarns advancing from the guide roll.

3. The apparatus of claim 1, wherein the yarn guides comprise deflection rolls which are constructed for being driven individually or in groups.

4. The apparatus of claim 1, further comprising a companion roll positioned adjacent and substantially parallel to the guide roll and so as to permit advancing the yarns on the guide roll with several loopings.

5. The apparatus of claim 1, wherein the takeup unit further comprises a yarn traversing device at each of the winding positions and arranged directly downstream of the associated yarn guide.

6. The apparatus of claim 1, further comprising a deflection device arranged in the path of the advancing yarns and upstream of the guide roll for varying the path of the advancing yarns by an angle of about 90°.

7. The apparatus of claim 6, wherein the deflection device is formed by one or more guide rolls that are obliquely arranged between a direction of yarn advance upstream thereof and a direction of yarn advance downstream thereof.

8. The apparatus of claim 1, wherein the at least one treatment unit comprises a draw zone, which is used to draw the freshly spun yarns before winding.

9. The apparatus of claim 8, wherein the draw zone comprises a withdrawal godet and a downstream draw godet, and wherein the guide roll comprises the draw godet.

10. The apparatus of claim 9, wherein the godets of the draw zone have longitudinal axes which are substantially vertically oriented.

11. The apparatus of claim 1, wherein the at least one treatment unit comprises a crimping device and a feed system downstream thereof, so as to impart a crimp to each yarn before winding.

12. The apparatus of claim 11, wherein the feed system comprises a driven godet, and wherein the guide roll comprises the driven godet.

13. The apparatus of claim 1, wherein the guide roll and yarn guides are positioned so that the yarns are guided between the guide roll and the yarn guides along a direction substantially parallel to the longitudinal axis.

* * * * *